US008261727B2

(12) United States Patent
Bagnasco et al.

(10) Patent No.: US 8,261,727 B2
(45) Date of Patent: Sep. 11, 2012

(54) INDIVIDUAL CYLINDER FUEL CONTROL SYSTEMS AND METHODS FOR OXYGEN SENSOR DEGRADATION

(75) Inventors: Andrew P. Bagnasco, Plymouth, MI (US); Thomas J. Majcher, Orchard Lake, MI (US)

(73) Assignee: GM Global Technology Operations LLC

( * ) Notice: Subject to any disclaimer, the term of this patent is extended or adjusted under 35 U.S.C. 154(b) by 3 days.

(21) Appl. No.: 12/898,109

(22) Filed: Oct. 5, 2010

(65) Prior Publication Data

US 2012/0080016 A1 Apr. 5, 2012

(51) Int. Cl.
*F02D 41/30* (2006.01)

(52) U.S. Cl. ..... 123/673; 123/436

(58) Field of Classification Search ..... 123/436, 123/672, 673, 704; 701/103–105, 109–110; 60/285

See application file for complete search history.

(56) References Cited

U.S. PATENT DOCUMENTS

| | | | | |
|---|---|---|---|---|
| 6,314,952 | B1 | 11/2001 | Turin et al. | |
| 6,382,198 | B1 * | 5/2002 | Smith et al. | 123/673 |
| 7,802,563 | B2 * | 9/2010 | Behr et al. | 123/692 |
| 7,926,330 | B2 * | 4/2011 | Huang et al. | 73/114.38 |

* cited by examiner

*Primary Examiner* — Hai Huynh

(57) ABSTRACT

A system includes an offset determination module and a correction determination module. The offset determination module determines an offset value based on an average response time of an exhaust gas oxygen (EGO) sensor located upstream of a catalyst in an exhaust system. The offset value relates one of a predetermined number of cylinder imbalance values to a cylinder of an engine. The correction determination module determines a fueling correction for the cylinder based on the offset value and one of the predetermined number of cylinder imbalance values.

20 Claims, 8 Drawing Sheets

INDIVIDUAL CYLINDER FUEL CONTROL SYSTEMS AND METHODS FOR OXYGEN SENSOR DEGRADATION

FIELD

The present disclosure relates to internal combustion engines and more particularly to oxygen sensors.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A fuel control system controls provision of fuel to an engine. The fuel control system includes an inner control loop and an outer control loop. The inner control loop may use data from an exhaust gas oxygen (EGO) sensor located upstream from a catalyst in an exhaust system. The catalyst receives exhaust gas output by the engine.

The inner control loop controls the amount of fuel provided to the engine based on the data from the upstream EGO sensor. For example only, when the upstream EGO sensor indicates that the exhaust gas is rich, the inner control loop may decrease the amount of fuel provided to the engine. Conversely, the inner control loop may increase the amount of fuel provided to the engine when the exhaust gas is lean. Adjusting the amount of fuel provided to the engine based on the data from the upstream EGO sensor modulates the air/fuel mixture combusted within the engine at approximately a desired air/fuel mixture (e.g., a stoichiometry mixture).

The outer control loop may use data from an EGO sensor located downstream from the catalyst. For example only, the outer control loop may use the data from the upstream and downstream EGO sensors to determine an amount of oxygen stored by the catalyst and other suitable parameters. The outer control loop may also use the data from the downstream EGO sensor to correct the data provided by the upstream and/or downstream EGO sensors when the downstream EGO sensor provides unexpected data.

SUMMARY

A system includes an offset determination module and a correction determination module. The offset determination module determines an offset value based on an average response time of an exhaust gas oxygen (EGO) sensor located upstream of a catalyst in an exhaust system. The offset value relates one of a predetermined number of cylinder imbalance values to a cylinder of an engine. The correction determination module determines a fueling correction for the cylinder based on the offset value and one of the predetermined number of cylinder imbalance values.

A method includes determining an offset value based on an average response time of an exhaust gas oxygen (EGO) sensor located upstream of a catalyst in an exhaust system and determining a fueling correction for the cylinder based on the offset value and one of the predetermined number of cylinder imbalance values. The offset value relates one of a predetermined number of cylinder imbalance values to a cylinder of an engine; and In still other features, the systems and methods described above are implemented by a computer program executed by one or more processors. The computer program can reside on a tangible computer readable medium such as but not limited to memory, nonvolatile data storage, and/or other suitable tangible storage mediums.

Further areas of applicability of the present disclosure will become apparent from the detailed description provided hereinafter. It should be understood that the detailed description and specific examples are intended for purposes of illustration only and are not intended to limit the scope of the disclosure.

DETAILED DESCRIPTION

Figure 1:
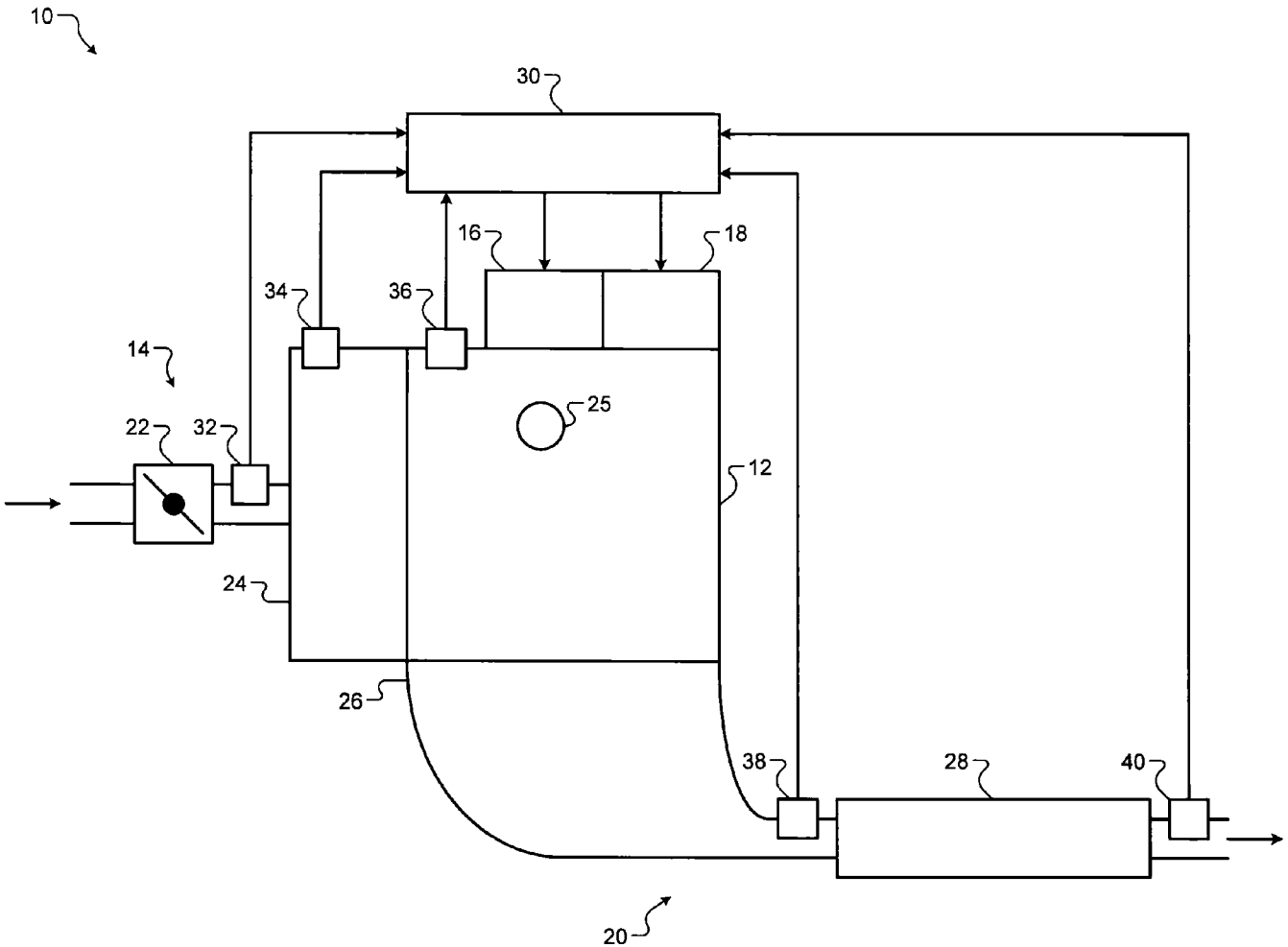
FIG. 1 is a functional block diagram of an exemplary engine system according to the principles of the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

An engine produces exhaust gas and expels the exhaust gas to an exhaust system. The exhaust gas travels through the exhaust system to a catalyst. An exhaust gas oxygen (EGO) sensor measures oxygen in the exhaust gas upstream of the catalyst and generates an output based on the measured oxygen.

An engine control module (ECM) controls an amount of fuel provided to the engine. The ECM monitors the output of the oxygen sensor and determines imbalance values for the cylinders of the engine, respectively, based on the output of the oxygen sensor. The ECM determines an offset value that relates one of the imbalance values to one of the cylinders of the engine. Based on the offset value and a firing order of the cylinders, the other imbalance values can be correlated to the other cylinders of the engine. The ECM determines fuel corrections for the cylinders based on the imbalance values, respectively.

Over time, a response time of the EGO sensor may slow (i.e., increase). The slowing of the response time may render the offset value inaccurate. Inaccuracy in the offset value may also affect the fuel corrections. The ECM of the present disclosure determines the offset value based on the response time of the EGO sensor.

The slowing of the response time may also affect a variance value determined based on the imbalance values. For example only, the variance value may decrease as the response time slows. The ECM selectively performs a re-synchronization event when the variance value is greater than a predetermined variance value. A re-synchronization event may include determining a new set of imbalance values for the cylinders, determining a new offset value, correlating the new imbalance values with the cylinders, and disabling the generation of fuel corrections based on the imbalance values, respectively, during the re-synchronization. Because the variance changes with the response time, the ECM of the present disclosure determines the predetermined variance based on the response time of the EGO sensor.

Referring now to FIG. 1, a functional block diagram of an exemplary implementation of an engine system 10 is presented. The engine system 10 includes an engine 12, an intake system 14, a fuel system 16, an ignition system 18, and an exhaust system 20. The engine 12 may include, for example, a gasoline type engine, a diesel type engine, a hybrid type engine, or another suitable type of engine.

The intake system 14 includes a throttle 22 and an intake manifold 24. The throttle 22 controls air flow into the intake manifold 24. Air flows from the intake manifold 24 into one or more cylinders within the engine 12, such as cylinder 25. While only the cylinder 25 is shown, the engine 12 may include more than one cylinder.

The fuel system 16 controls the provision of fuel to the engine 12. The ignition system 18 selectively ignites an air/fuel mixture within the cylinders of the engine 12. The air of the air/fuel mixture is provided via the intake system 14, and the fuel of the air/fuel mixture is provided by the fuel system 16. In some engine systems, such as diesel type engine systems, the ignition system 18 may be omitted.

Exhaust gas resulting from combustion of the air/fuel mixture is expelled from the engine 12 to the exhaust system 20. The exhaust system 20 includes an exhaust manifold 26 and a catalyst 28. For example only, the catalyst 28 may include a catalytic converter, a three way catalyst (TWC), and/or another suitable type of catalyst. The catalyst 28 receives the exhaust gas output by the engine 12 and reduces the amounts of various components of the exhaust gas.

The engine system 10 also includes an engine control module (ECM) 30 that regulates operation of the engine system 10. The ECM 30 communicates with the intake system 14, the fuel system 16, and the ignition system 18. The ECM 30 also communicates with various sensors. For example only, the ECM 30 may communicate with a mass air flow (MAF) sensor 32, a manifold air pressure (MAP) sensor 34, a crankshaft position sensor 36, and other suitable sensors.

The MAF sensor 32 measures a mass flowrate of air flowing into the intake manifold 24 and generates a MAF signal based on the mass flowrate. The MAP sensor 34 measures pressure within the intake manifold 24 and generates a MAP signal based on the pressure. In some implementations, engine vacuum may be measured with respect to ambient pressure. The crankshaft position sensor 36 monitors rotation of a crankshaft (not shown) of the engine 12 and generates a crankshaft position signal based on the rotation of the crankshaft. The crankshaft position signal may be used to determine an engine speed (e.g., in revolutions per minute). The crankshaft position signal may also be used for cylinder identification.

The ECM 30 also communicates with exhaust gas oxygen (EGO) sensors associated with the exhaust system 20. For example only, the ECM 30 communicates with an upstream EGO sensor (US EGO sensor) 38 and a downstream EGO sensor (DS EGO sensor) 40. The US EGO sensor 38 is located upstream of the catalyst 28, and the DS EGO sensor 40 is located downstream of the catalyst 28. The US EGO sensor 38 may be located, for example, at a confluence point of exhaust runners (not shown) of the exhaust manifold 26 or at another suitable location.

The US and DS EGO sensors 38 and 40 measure oxygen concentration of the exhaust gas at their respective locations and generate an EGO signal based on the oxygen concentration. For example only, the US EGO sensor 38 generates an upstream EGO (US EGO) signal based on the oxygen concentration upstream of the catalyst 28, and the DS EGO sensor 40 generates a downstream EGO (DS EGO) signal based on oxygen concentration downstream of the catalyst 28.

The US and DS EGO sensors 38 and 40 may each include a switching EGO sensor, a universal EGO (UEGO) sensor (also referred to as a wide band or wide range EGO sensor), or another suitable type of EGO sensor. A switching EGO sensor generates an EGO signal in units of voltage, and switches the EGO signal between a low voltage (e.g., approximately 0.2 V) and a high voltage (e.g., approximately 0.8 V) when the oxygen concentration is lean and rich, respectively. A UEGO sensor generates an EGO signal that corresponds to an equivalence ratio (EQR) of the exhaust gas and provides measurements between rich and lean.

Figure 2:
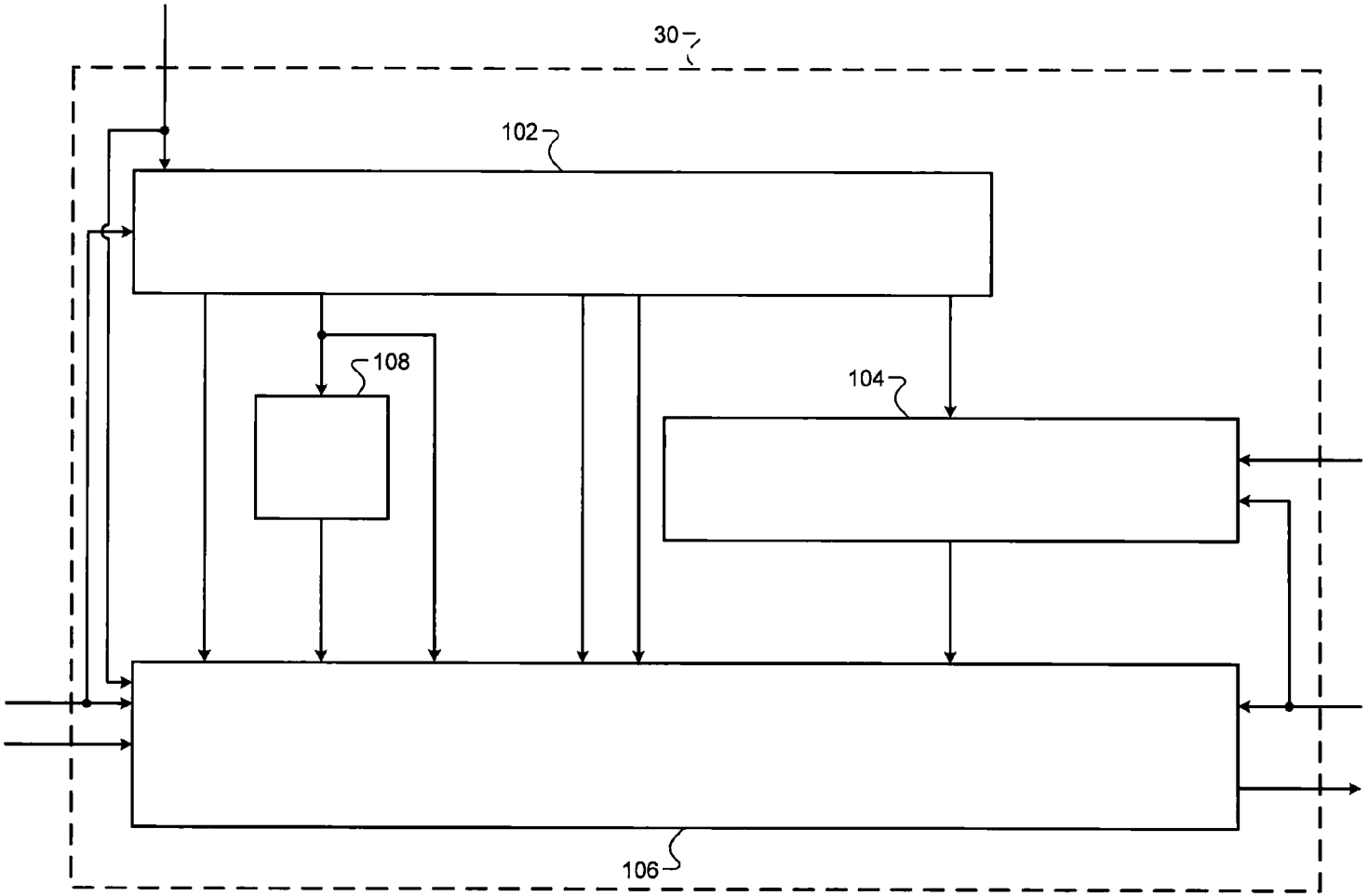
FIG. 2 is a functional block diagram of an exemplary engine control module according to the principles of the present disclosure.

Referring now to FIG. 2, a functional block diagram of an exemplary implementation of the ECM 30 is shown. The ECM 30 includes a command generator module 102, an outer loop module 104, an inner loop module 106, and a reference generation module 108. The command generator module 102 may determine engine operating conditions. For example only, the engine operating conditions may include, but are not limited to, the engine speed, air per cylinder (APC), engine load, and/or other suitable parameters. The APC may be predicted for one or more future combustion events in some engine systems. The engine load may be determined based on, for example, a ratio of the APC to a maximum APC of the engine 12. The engine load may alternatively be determined based on an indicated mean effective pressure (IMEP), engine torque, or another suitable parameter indicative of engine load.

The command generator module 102 generates a base equivalence ratio (EQR) request. The base EQR request may correspond to a desired equivalence ratio (EQR) of the air/fuel mixture to be combusted within one or more cylinders of the engine 12. For example only, the desired EQR may include a stoichiometric EQR (i.e., 1.0). The command generator module 102 also determines a desired downstream exhaust gas output (a desired DS EGO). The command generator module 102 may determine the desired DS EGO based on, for example, the engine operating conditions.

The command generator module 102 may also generate one or more open-loop fueling corrections for the base EQR request. The fueling corrections may include, for example, a sensor correction and an error correction. For example only, the sensor correction may correspond to a correction to the base EQR request to accommodate the measurements of the US EGO sensor 38. The error correction may correspond to a correction in the base EQR request to account for errors that may occur, such as errors in the determination of the APC and errors attributable to provision of fuel vapor to the engine 12 (i.e., fuel vapor purging).

The outer loop module 104 may also generate one or more open-loop fueling corrections for the base EQR request. The outer loop module 104 may generate, for example, an oxygen storage correction and an oxygen storage maintenance correction. For example only, the oxygen storage correction may correspond to a correction in the base EQR request to adjust the oxygen storage of the catalyst 28 to a desired oxygen storage within a predetermined period. The oxygen storage maintenance correction may correspond to a correction in the base EQR request to modulate the oxygen storage of the catalyst 28 at approximately the desired oxygen storage.

The outer loop module 104 estimates the oxygen storage of the catalyst 28 based on the US EGO signal and the DS EGO signal. The outer loop module 104 may generate the fueling corrections to adjust the oxygen storage of the catalyst 28 to the desired oxygen storage and/or to maintain the oxygen storage at approximately the desired oxygen storage. The outer loop module 104 may also generate the fueling corrections to minimize a difference between the DS EGO signal and the desired DS EGO.

The inner loop module 106 determines an upstream EGO correction (US EGO correction) based on a difference between the US EGO signal and an expected US EGO. The US EGO correction may correspond to, for example, a correction in the base EQR request to minimize the difference between the US EGO signal and the expected US EGO. The inner loop module 106 also determines an imbalance correction (see FIGS. 3 and 4). The imbalance correction may correspond to, for example, a correction in the base EQR request to balance the cylinders.

The reference generation module 108 generates a reference signal. For example only, the reference signal may include a sinusoidal wave, triangular wave, or another suitable type of periodic signal. The reference generation module 108 may selectively vary the amplitude and frequency of the reference signal. For example only, the reference generation module 108 may increase the frequency and amplitude as the engine load increases and may decrease the frequency and amplitude as the engine load decreases. The reference signal may be provided to the inner loop module 106 and one or more other modules.

The inner loop module 106 determines a final EQR request based on the base EQR request and the US EGO correction. The inner loop module 106 determines the final EQR request further based on the sensor correction, the error correction, the oxygen storage correction, and the oxygen storage maintenance correction, and the reference signal. For example only, the inner loop module 106 determines the final EQR request based on a sum of the base fuel command, the US EGO correction, the sensor correction, the error correction, the oxygen storage correction, and the oxygen storage maintenance correction, the imbalance correction, and the reference signal. The ECM 30 controls the fuel system 16 based on the final EQR request.

The reference signal may be used in determining the final EQR request to transition the EQR of the exhaust gas provided to the catalyst 28 between a predetermined rich EQR and a predetermined lean EQR and vice versa. For example only, the predetermined rich EQR may be approximately 3 percent rich (e.g., an EQR of 1.03), and the predetermined lean EQR may be approximately 3 percent lean (e.g., an EQR of approximately 0.97). Transitioning the EQR may improve the efficiency of the catalyst 28. Additionally, transitioning the EQR may be useful in diagnosing faults in the US EGO sensor 38, the catalyst 28, and/or the DS EGO sensor 40.

Figure 3:
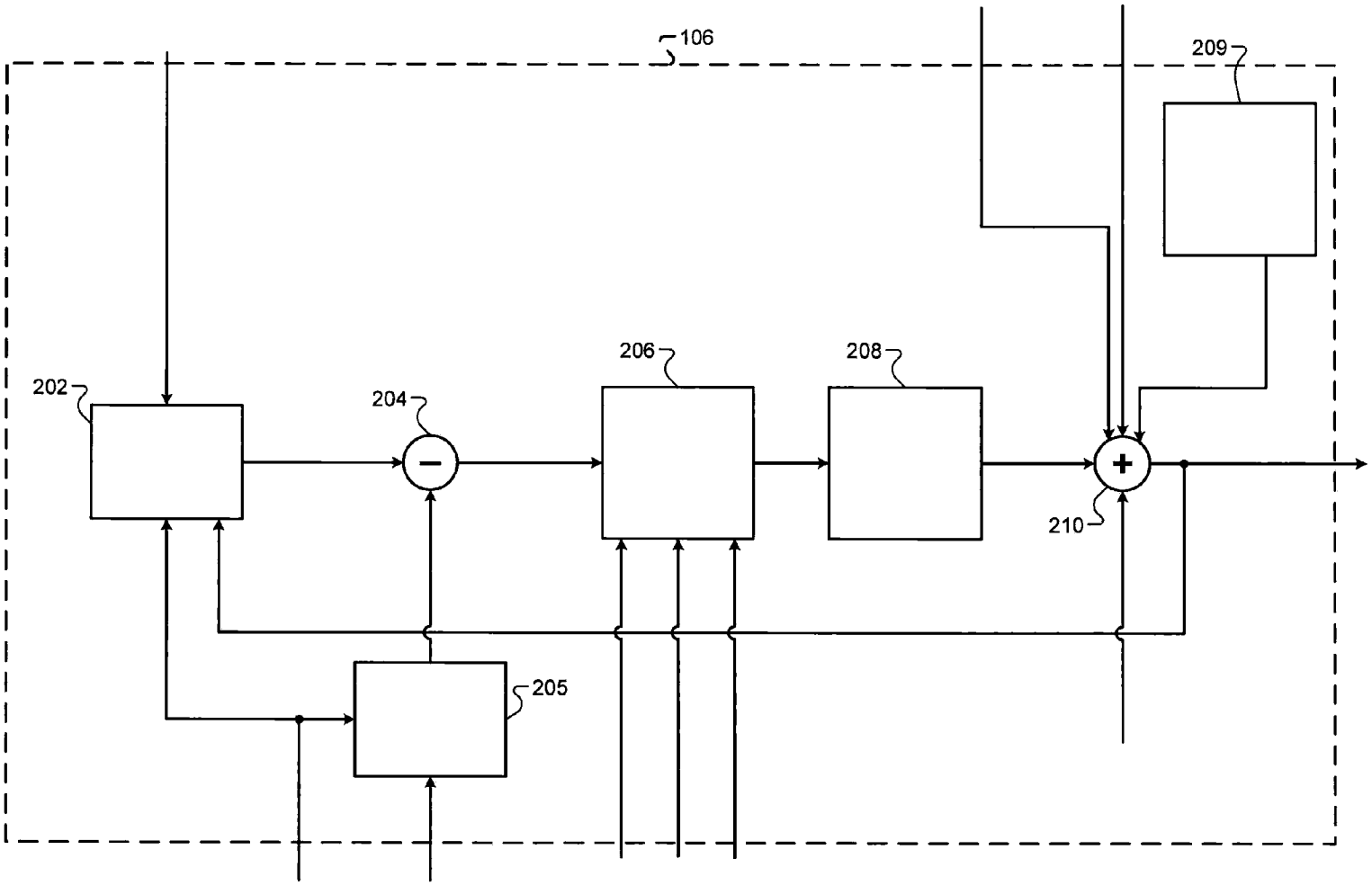
FIG. 3 is a functional block diagram of an exemplary inner loop module according to the principles of the present disclosure.

Referring now to FIG. 3, a functional block diagram of an exemplary implementation of the inner loop module 106 is presented. The inner loop module 106 may include an expected US EGO module 202, an error module 204, a sampling module 205, a scaling module 206, a compensator module 208, an imbalance correction module 209, and a final EQR module 210.

The expected US EGO module 202 determines the expected US EGO. The expected US EGO module 202 determines the expected US EGO based on the final EQR request. The expected US EGO corresponds to an expected value of the US EGO signal. However, delays of the engine system 10 prevent the exhaust gas resulting from combustion from being immediately reflected in the US EGO signal. The delays of the engine system 10 may include, for example, an engine delay, a transport delay, and a sensor delay.

The engine delay may correspond to a period between, for example, when fuel is provided to a cylinder of the engine 12 and when the resulting burned air/fuel (exhaust gas) mixture is expelled from the cylinder. The transport delay may correspond to a period between when the resulting exhaust gas is expelled from the cylinder and when the resulting exhaust gas reaches the location of the US EGO sensor 38. The sensor delay may correspond to the delay between when the resulting exhaust gas reaches the location of the US EGO sensor 38 and when the resulting exhaust gas is reflected in the US EGO signal.

The US EGO signal may also reflect a mixture of the exhaust gas produced by different cylinders of the engine 12. The expected US EGO module 202 accounts for exhaust gas mixing in determining the expected US EGO. The expected US EGO module 202 stores the EQR of the final EQR request. The expected US EGO module 202 determines the expected US EGO based on or more stored EQRs.

The error module 204 determines an upstream EGO error (US EGO error) based on a sample of the US EGO signal (i.e., a US EGO sample) and the expected US EGO. More specifically, the error module 204 determines the US EGO error based on a difference between the US EGO sample and the expected US EGO.

The sampling module 205 selectively samples the US EGO signal and provides the US EGO sample to the error module 204. The sampling module 205 may sample the US EGO signal at a predetermined rate, such as once per predetermined number of crankshaft angle degrees (CAD). The predetermined rate may be set based on the number of cylinders of the engine, the number of EGO sensors implemented, the firing order of the cylinders, and engine configuration. For example only, for a four cylinder engine with one cylinder bank and one EGO sensor, the predetermined rate may be eight CAD based samples per engine cycle.

The scaling module 206 determines a fuel error based on the US EGO error. The scaling module 206 may apply one or more gains or other suitable control factors in determining the fuel error based on the US EGO error. For example only, the scaling module 206 may determine the fuel error using the equation:

$$\text{Fuel Error} = \frac{MAF}{14.7} * US\ EGO\ \text{Error}. \quad (1)$$

In another implementation, the scaling module 206 may determine the fuel error using the equation:

$$\text{Fuel Error} = k(\text{MAP,RPM}) * \text{US EGO Error}, \quad (2)$$

where RPM is the engine speed and k is based on a function of the MAP and the engine speed. In some implementations, k may be based on a function of the engine load.

The compensator module 208 determines the US EGO correction based on the fuel error. For example only, the compensator module 208 may employ a proportional-integral (PI) control scheme, a proportional (P) control scheme, a proportional-integral-derivative (PID) control scheme, or another suitable control scheme in determining the US EGO correction based on the fuel error.

The imbalance correction module 209 (see FIG. 4) monitors the US EGO samples. The imbalance correction module 209 determines imbalance values for the cylinders of the engine 12 based on the US EGO samples and an average of a predetermined number of previous US EGO samples. The imbalance correction module 209 determines an offset value that relates one of the imbalance values to one of the cylinders of the engine 12. The imbalance correction module 209 correlates the other cylinders of the engine with the other imbalance values, respectively, based on the firing order of the cylinders. The imbalance correction module 209 determines an imbalance correction based on the imbalance value of the next cylinder in the firing order.

The final EQR module 210 determines the final EQR request based on the base EQR request, the reference signal, the US EGO correction, and the open-loop fueling correction (s). For example only, the final EQR module 210 may determine the final EQR request based on the sum of the base EQR request, the reference signal, the US EGO correction, the imbalance correction, and the open-loop fueling correction (s). The fuel system 16 controls the provision of fuel to the next cylinder in the firing order based on the final EQR request.

Figure 4:
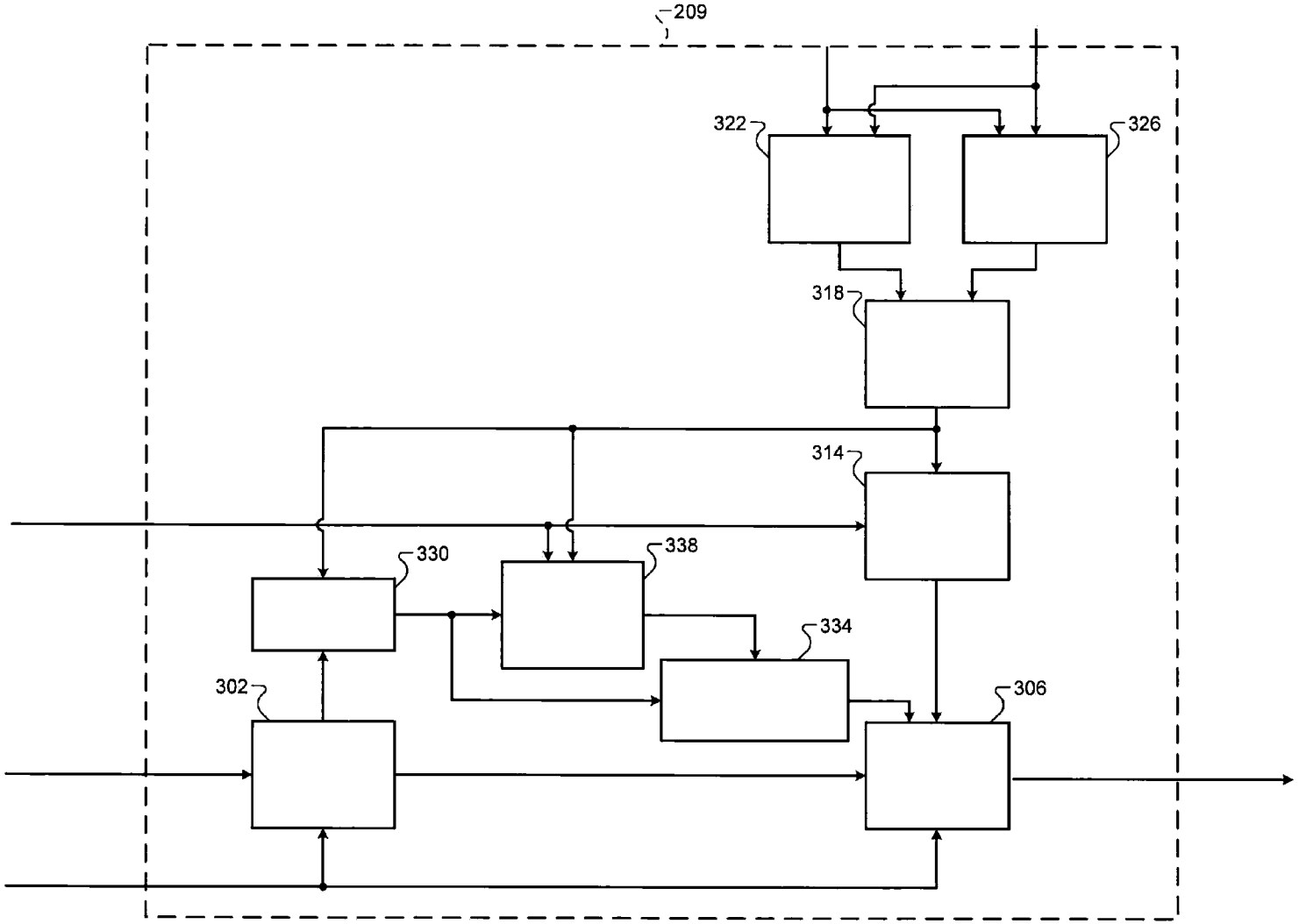
FIG. 4 is a functional block diagram of an exemplary imbalance correction module according to the principles of the present disclosure.

Referring now to FIG. 4, a functional block diagram of an exemplary implementation of the imbalance correction module 209 is presented. The imbalance correction module 209 may include an observer module 302, a correction determination module 306, an offset determination module 314, a response time module 318, a rich to lean (R2L) response time module 322, and a lean to rich (L2R) response time module 326. The expected US EGO module 202 may also include a variance determination module 330, a re-synchronization triggering module 334, and a threshold determination module 338.

The observer module 302 monitors the US EGO samples and may store the US EGO samples. The observer module 302 determines an average of a predetermined number of previous US EGO samples. For example only, the predetermined number of previous EGO samples may be one engine cycle worth of US EGO samples. One engine cycle refers to two complete revolutions of a crankshaft of the engine 12 (i.e., 720° of crankshaft rotation). The average may include a weighted average or another suitable type of average. The observer module 302 may update the average each time that a new US EGO sample is received based on the new US EGO sample.

The observer module 302 determines an imbalance value when a US EGO sample is received for the US EGO sample. The observer module 302 determines the imbalance value based on a difference between the average and the US EGO sample. Accordingly, an imbalance value of zero indicates that the cylinder associated with the imbalance value of zero is balanced relative to the average.

The observer module 302 stores the imbalance value with a predetermined number of previously determined imbalance values. In this manner, a predetermined number (N) of the most recent determined imbalance values may be stored in the observer module 302, where N is an integer. N may be may be set to, for example, at least a predetermined minimum number of imbalance values that is based on US EGO samples per engine cycle. For example only, the predetermined minimum number may be equal to two times the rate of combustion events monitored by the US EGO sensor 38.

An offset value relates one of the stored imbalance values of the observer module 302 to one of the cylinders of the engine 12. Once the offset value is known, the other ones of the stored imbalance values can be correlated with the other ones of the cylinders of the engine 12 using the firing order. The correction determination module 306 retrieves the imbalance value associated with the next cylinder in the firing order and determines the imbalance correction based on the imbalance value. More specifically, the correction determination module 306 determines the imbalance correction to adjust the imbalance value for the next cylinder toward zero, thereby balancing the next cylinder. For example only, the correction determination module 306 may determine the imbalance correction using an integral (I) control scheme or another suitable type of control scheme. The correction determination module 306 may output the imbalance correction to the final EQR module 210.

Degradation of the US EGO sensor 38 (e.g., aging), however, may affect a response time of the US EGO sensor 38. For example only, an exemplary graphs of offset as a function of an average response time of the US EGO sensor 38 are presented in FIGS. 5A-5B.

Figure 5B:
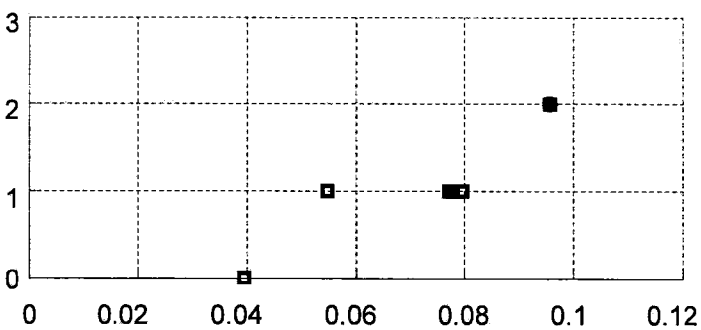
FIGS. 5A-5B are exemplary graphs of offset value as a function of average response time according to the principles of the present disclosure.
Figure 5A:
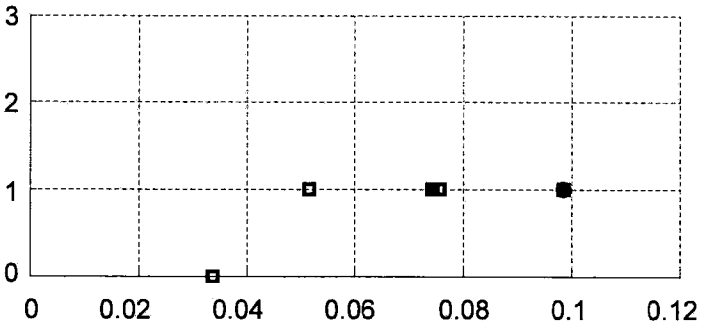

Referring to FIGS. 5A-5B, in an initial form (i.e., non-degraded or new), the response time of the US EGO sensor 38 may be approximately a predetermined response time. For example only, the predetermined response time may be approximately 0.42 ms. Degradation of the US EGO sensor 38, however, may cause the response time of the US EGO sensor 38 to slow (i.e., increase). With the increased response time, the offset value may change under the same circumstances. If the change in the offset value is not accounted for, imbalance correction may become less accurate, and the cylinders may become more imbalanced. FIG. 5A includes samples of average response time versus offset value for a first bank of cylinders under light and heavy engine load conditions. FIG. 5B includes samples of average response time versus offset value for a second bank of cylinders under light and heavy engine load conditions.

Referring back to FIG. 4, the offset determination module 314 determines the average response time of the US EGO sensor 38. The offset determination module 314 determines the offset value based on the average response time of the US EGO sensor 38 and the engine load. As stated above, the engine load may be determined based on the APC. In various implementations, the engine load may instead be based on engine torque, indicated mean effective pressure (IMEP), or another suitable parameter indicative of the engine load.

The offset determination module 314 may determine the offset value from one or more mappings that relate the engine load and the average response time to the offset value, using a function that relates the engine load and the average response time to the offset value, or in another suitable manner based on the engine load and the average response time. If the offset value is not an integer, the offset determination module 314 may round the offset value down to a nearest integer.

In various implementations, the offset determination module 314 may determine the offset value based on only the engine load before a re-synchronization is triggered. When a re-synchronization is triggered, the offset determination module may determine the offset value based on the engine load and the average response time.

The response time module 318 provides the average response time of the US EGO sensor 38 to the offset determination module 314. The response time module 318 may determine the average response time based on an average of a rich to lean (R2L) response time and a lean to rich (L2R) response time. For example only, the response time module 318 may determine the average response time using the equation:

$$\text{Average Response Time} = \frac{R2L\ RT + L2R\ RT}{2},$$

where R2L RT is the R2L response time and L2R RT is the L2R response time.

The R2L response time module 322 may determine the R2L response time and provides the R2L response time to the response time module 318. The R2L response time module 322 may determine the R2L response time based on an average of a predetermined number of previous response times of the US EGO sensor 38. A given one of the previous response times may refer to a period of time between a first time when final EQR request is transitioned from a rich EQR to a lean EQR and a second time when the US EGO sample reflects the transition. The reference signal may be used to determine the first time (i.e., when the final EQR request is transitioned from a rich EQR to a lean RQR). The US EGO sample may reflect the transition, for example, when the US EGO sample is within a predetermined amount or percentage of the predetermined lean EQR. In various implementations, the imbalance correction module 209 may receive the R2L response time from another module, such as an oxygen sensor diagnostic module (not shown).

The L2R response time module 326 may determine the L2R response time and provides the L2R response time to the response time module 318. The L2R response time module 326 may determine the L2R response time based on an average of a predetermined number of previous response times of the US EGO sensor 38. A given one of the previous response times may refer to a period of time between a first time when final EQR request is transitioned from a lean EQR to a rich EQR and a second time when the US EGO sample reflects the transition. The reference signal may be used to determine the first time (i.e., when the final EQR request is transitioned from a lean EQR to a rich RQR). The US EGO sample may reflect the transition, for example, when the US EGO sample is within a predetermined amount or percentage of the predetermined rich EQR. In various implementations, the imbalance correction module 209 may receive the L2R response time from another module, such as the oxygen sensor diagnostic module (not shown).

Determining the offset value based on the response time of the US EGO sensor 38 ensures that the offset value accounts for slowing of the average response time of the US EGO sensor 38. Determining the offset value based on the average response time decreases the possibility of creating increased imbalance due to incorrect synchronization. However, the response time of the US EGO sensor 38 may also affect a variance of the imbalance values.

The variance determination module 330 determines the variance value based on the stored imbalance values. For example only, the variance determination module 330 may determine a standard deviation of the stored imbalance values and determine the variance value as a square of the standard deviation.

Figure 6:
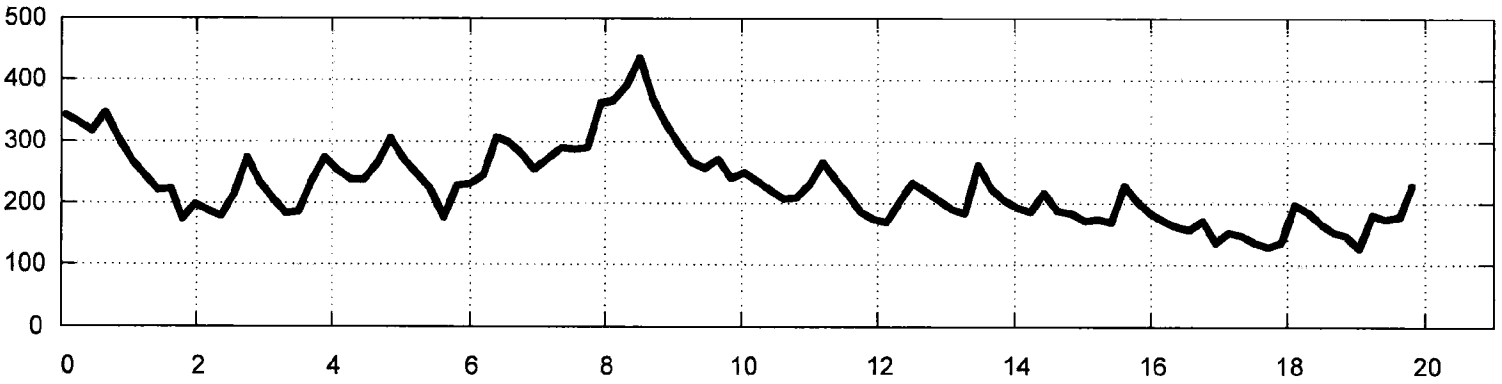
FIGS. 6 and 7 are exemplary graphs of variance as functions of time for exhaust gas oxygen sensors having relatively faster and relatively slower average response times, respectively, according to the principles of the present disclosure.
Figure 7:
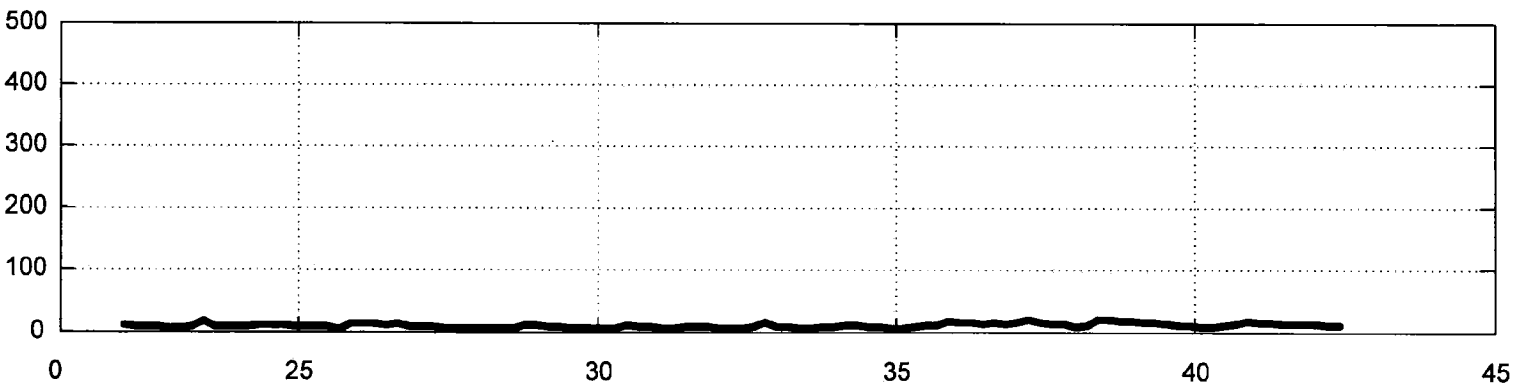

FIG. 6 includes an exemplary graph of the variance value as a function of time with a predetermined imbalance (e.g., 10 percent) and a US EGO sensor in the initial form. FIG. 7 includes an exemplary graph of the variance value as a function of time with the predetermined imbalance and a US EGO sensor in a degraded form (i.e., a slower response time). As can be gleaned from a comparison of FIGS. 6 and 7, the variance value is effectively muted by the slower response time.

Referring back to FIG. 4, as stated above, the correction determination module 306 determines the imbalance correction using the offset value. The re-synchronization triggering module 334 selectively prompts a re-synchronization based on the variance value. More specifically, the re-synchronization triggering module 334 selectively prompts a re-synchronization based on a comparison of the variance value and a variance threshold.

Performance of a re-synchronization involves resetting the imbalance values as the imbalance and the correction values to zero, determining new imbalance values, and updating the offset value. The offset value may be determined by table look up, trial and error, or probing. The offset value relates one of the new imbalance values with one of the cylinders. The other cylinders can then be correlated to specific ones of the new imbalance values based on knowledge of the firing order and the engine configuration.

The re-synchronization triggering module 334 may trigger a re-synchronization based on a comparison of the variance value and a variance threshold. More specifically, the re-synchronization triggering module 334 may trigger a re-synchronization when the variance value is greater than the variance threshold.

The threshold determination module 338 determines the variance threshold and provides the variance threshold to the re-synchronization triggering module 334. In various implementations, the threshold determination module 338 may determine the variance threshold based on the engine load and the average response time. For example only, the threshold determination module 338 may determine the variance threshold using a function or a mapping that relates the engine load and the average response time to the variance threshold.

In other implementations, re-synchronization triggering module 334 may trigger a re-synchronization based on a comparison of an adjusted variance value and a variance threshold. The variance determination module 330 may determine the adjusted variance value based on the variance value, the average response time, and a nominal response time. For example only, the variance determination module 330 may determine the adjusted variance value using the equation:

$$\text{Adjusted Variance} = \text{Variance} * \frac{Avg\ RT}{Nom\ RT},$$

where Adjusted Variance is the adjusted variance value, Variance is the variance value, AvgRT is the average response time, and NomRT is the nominal response time. For example only, the nominal response time may be the response time of the US EGO sensor 38 in its initial form and may be a predetermined response time. In such implementations, the threshold determination module 338 may determine the variance threshold based on the engine load, such as using a function or a mapping that relates the engine load to the variance threshold.

Figure 8:
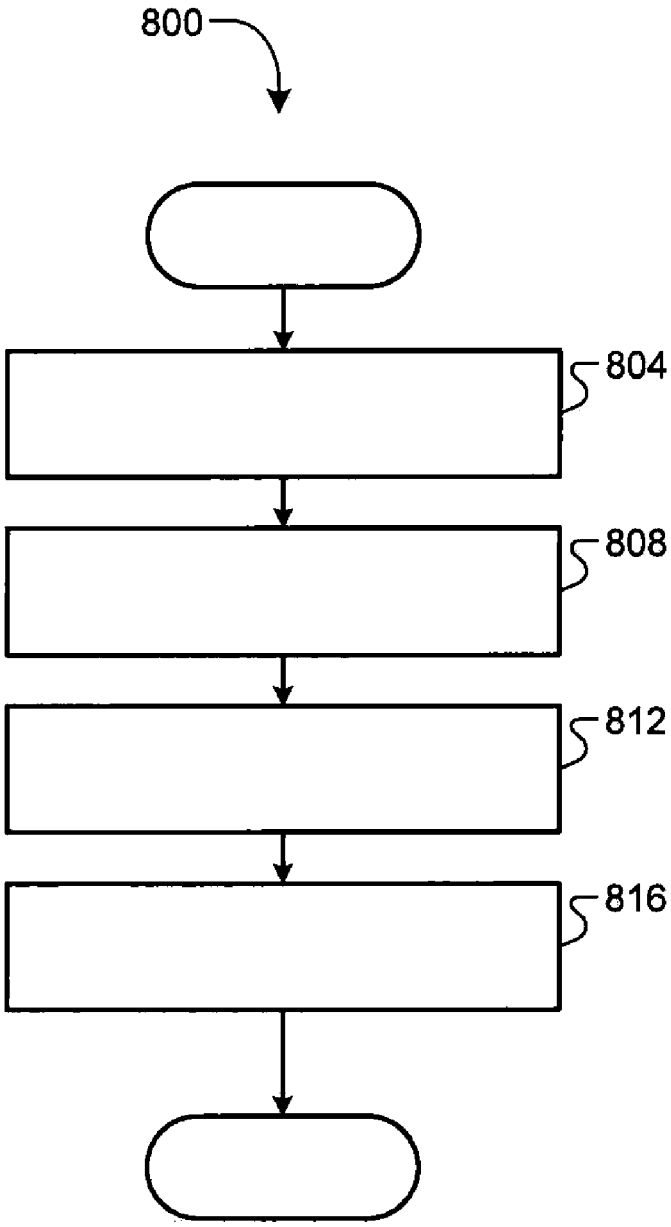
FIG. 8 is a flowchart depicting an exemplary method of determining the offset value according to the principles of the present disclosure.

Referring now to FIG. 8, a flowchart depicting an exemplary method 800 of determining the offset value is presented. Control may begin with 804 where control determines the R2L response time for the US EGO sensor 38. Control may determine the R2L response time as an average of a predetermined number of previous response times of the US EGO sensor 38 in outputting the US EGO signal indicative of previous rich to lean (i.e., R2L) transitions, respectively.

Control determines the L2R response time for the US EGO sensor 38 at 808. Control may determine the L2R response time as an average of a predetermined number of previous response times of the US EGO sensor 38 in outputting the US EGO signal indicative of previous lean to rich (i.e., L2R) transitions, respectively.

At 812, control determines the average response time for the US EGO sensor 38. Control may determine the average response time as the average of the R2L response time and the L2R response time. Control determines the offset value based on the engine load at 816. Control may determine the offset value further based on the average response time at 816. In various implementations, control may determine the offset value based on the engine load at 816 and, after a re-synchronization is triggered, determine the offset value based on the engine load and the average response time. Control may then end.

Figure 9A:
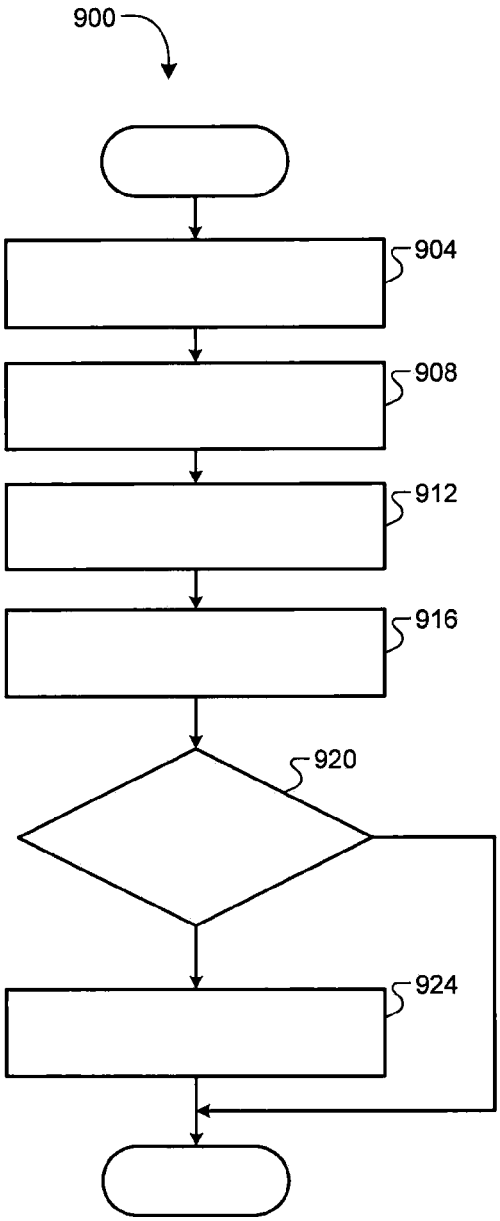
FIGS. 9A-9B are an exemplary methods of determining a variance threshold and selectively triggering a re-synchronization event according to the principles of the present disclosure.

Referring now to FIG. 9A, a flowchart depicting an exemplary method 900 of determining a variance threshold and selectively triggering a re-synchronization is presented. Control may begin with 904 where control determines the average response time of the US EGO sensor 38. Control determines the offset value based on the average response time at 908.

At 912, control determines the variance value. Control may determine the variance value based on the square of the standard deviation of the imbalance values. Control determines the variance threshold at 916. Control may determine the variance threshold based on the average response time and the engine load. Control may determine the variance threshold further based on the engine speed. Control determines whether the variance value is greater than the variance threshold at 920. If true, control may trigger a re-synchronization at 924 and end; if false, control may end.

Figure 9B:
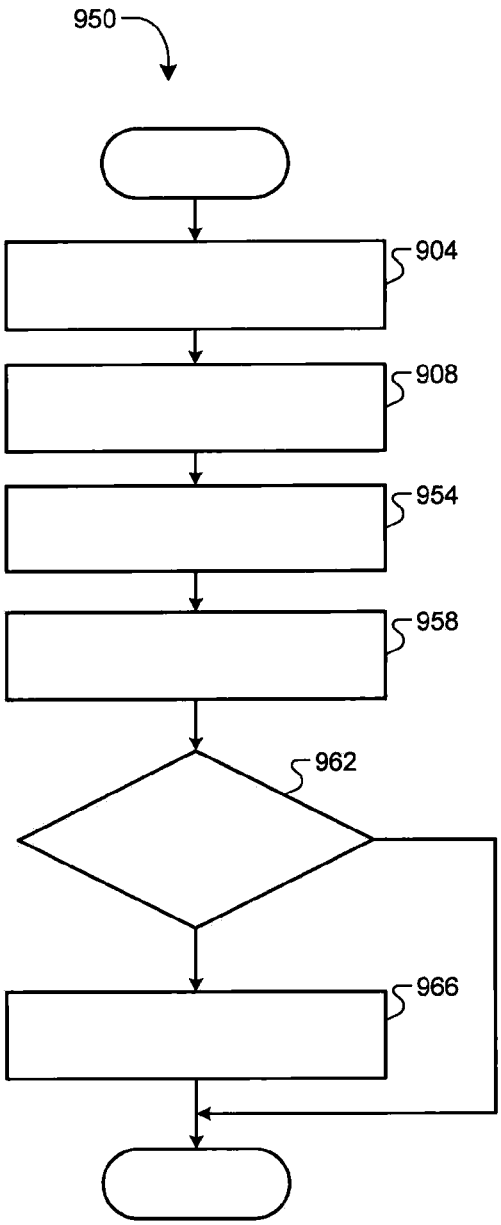

Referring now to FIG. 9B, another flowchart depicting an exemplary method 950 of determining a variance threshold and selectively triggering a re-synchronization is presented. Control may perform 904-908 as discussed above. At 954, control may determine the adjusted variance value. Control may determine the adjusted variance value based on the variance value, the average response time, and the nominal response time.

Control determines the variance threshold at 958. Control determines the variance threshold based on the engine load. Control determines whether the adjusted variance value is greater than the variance threshold at 920. If true, control may trigger a re-synchronization at 966 and end; if false, control may end.

The broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A system comprising:

an offset determination module that determines an offset value based on an average response time of an exhaust gas oxygen (EGO) sensor located upstream of a catalyst in an exhaust system, wherein the offset value relates one of a predetermined number of cylinder imbalance values to a cylinder of an engine; and a correction determination module that determines a fueling correction for the cylinder based on the offset value and one of the predetermined number of cylinder imbalance values.

2. The system of claim 1 further comprising a final EQR module that determines a final EQR request based on a base EQR request and the fueling correction and that controls fuel to the cylinder based on the final EQR request.

3. The system of claim 1 wherein the offset determination module determines the offset value further based on an engine load.

4. The system of claim 1 further comprising:

a first response time module that determines a first response time of the EGO sensor to a rich to lean transition;

a second response time module that determines a second response time of the EGO sensor to a lean to rich transition; and a third response time module that determines the average response time based on the first and second response times.

5. The system of claim 4 wherein the third response time module determines the average response time as an average of the first and second response times.

6. The system of claim 4 wherein the first response time module determines the first response time further based on a first average of a first predetermined number of previous rich to lean transitions, and wherein the second response time module determines the second response time further based on a second average of a second predetermined number of previous lean to rich transitions.

7. The system of claim 1 further comprising:

a threshold determination module that determines a variance threshold based on an engine load; and a re-synchronization module that selectively triggers a re-synchronization of the offset value with one of a predetermined number of new cylinder imbalance values based on the variance threshold.

8. The system of claim 7 further comprising a variance determination module that determines a variance value based on the cylinder imbalance values, wherein the threshold determination module determines the variance threshold further based on the average response time, and wherein the re-synchronization module triggers the re-synchronization when the variance value is greater than the variance threshold.

9. The system of claim 7 further comprising a variance determination module that determines a first variance value based on the cylinder imbalance values and that determines an adjusted variance value based on the first variance value and the average response time, wherein the re-synchronization triggering module triggers the re-synchronization when the adjusted variance value is greater than the variance threshold.

10. The system of claim 7 wherein the offset determination module, in response to the triggering of the re-synchronization, determines the offset value using one of a function and a mapping that relates the average response time to the offset value.

11. A method comprising:

determining an offset value based on an average response time of an exhaust gas oxygen (EGO) sensor located upstream of a catalyst in an exhaust system, wherein the offset value relates one of a predetermined number of cylinder imbalance values to a cylinder of an engine; and determining a fueling correction for the cylinder based on the offset value and one of the predetermined number of cylinder imbalance values.

12. The method of claim 11 further comprising:

determining a final EQR request based on a base EQR request and the fueling correction; and controlling fuel to the cylinder based on the final EQR request.

13. The method of claim 11 further comprising determining the offset value further based on an engine load.

14. The method of claim 11 further comprising:

determining a first response time of the EGO sensor to a rich to lean transition;

determining a second response time of the EGO sensor to a lean to rich transition; and determining the average response time based on the first and second response times.

15. The method of claim 14 further comprising determining the average response time as an average of the first and second response times.

16. The method of claim 14 further comprising:

determining the first response time further based on a first average of a first predetermined number of previous rich to lean transitions; and determining the second response time further based on a second average of a second predetermined number of previous lean to rich transitions.

17. The method of claim 11 further comprising:

determining a variance threshold based on an engine load; and selectively triggering a re-synchronization of the offset value with one of a predetermined number of new cylinder imbalance values based on the variance threshold.

18. The method of claim 17 further comprising:

determining a variance value based on the cylinder imbalance values;

determining the variance threshold further based on the average response time; and triggering the re-synchronization when the variance value is greater than the variance threshold.

19. The method of claim 17 further comprising:

determining a first variance value based on the cylinder imbalance values;

determining an adjusted variance value based on the first variance value and the average response time; and triggering the re-synchronization when the adjusted variance value is greater than the variance threshold.

20. The method of claim 17 further comprising, in response to the triggering of the re-synchronization, determining the offset value using one of a function and a mapping that relates the average response time to the offset value.

* * * * *